US005151137A

United States Patent [19]

Yoshizawa et al.

[11] Patent Number: 5,151,137

[45] Date of Patent: Sep. 29, 1992

[54] SOFT MAGNETIC ALLOY WITH ULTRAFINE CRYSTAL GRAINS AND METHOD OF PRODUCING SAME

[75] Inventors: Yoshihito Yoshizawa, Fukaya; Yoshio Bizen; Kiyotaka Yamauchi, both of Kumagaya; Toshikazu Nishiyama, Fukaya; Shigekazu Suwabe, Kumagaya, all of Japan

[73] Assignee: Hitachi Metals Ltd., Tokyo, Japan

[21] Appl. No.: 614,487

[22] Filed: Nov. 16, 1990

[30] Foreign Application Priority Data

Nov. 17, 1989 [JP] Japan ..... 1-298878
Feb. 27, 1990 [JP] Japan ..... 2-46620

[51] Int. Cl.[5] ..... C22C 19/07

[52] U.S. Cl. ..... 148/313; 148/3; 148/108; 148/304; 420/435; 420/436; 420/437; 420/438; 420/440

[58] Field of Search ..... 148/3, 13, 108, 304, 148/305, 313; 420/435, 436, 437, 438, 439, 440

[56] References Cited

U.S. PATENT DOCUMENTS

| | | | |
|---|---|---|---|
| 4,152,144 | 5/1979 | Hasegawa et al. | 420/95 |
| 4,379,004 | 4/1983 | Makino et al. | 148/108 |
| 4,439,236 | 3/1984 | Ray | 420/440 |
| 4,475,962 | 10/1984 | Hayakawa et al. | 148/108 |
| 4,668,310 | 5/1987 | Kudo et al. | 420/435 |
| 4,863,526 | 9/1989 | Miyagawa et al. | 148/13 |

FOREIGN PATENT DOCUMENTS

| | | |
|---|---|---|
| 0080521 | 6/1983 | European Pat. Off. . |
| 0161394 | 11/1985 | European Pat. Off. . |
| 3021536 | 12/1980 | Fed. Rep. of Germany . |
| 38808 | 4/1981 | Japan . |
| 64-73041 | 3/1989 | Japan . |

OTHER PUBLICATIONS

Journal of Applied Physics, vol. 53, No. 3, part II, Mar. 1982, pp. 2276–2278, New York, US; R. Hasegawa et al.: "Effects of Crystalline Precipitates on the Soft Magnetic properties of Metallic Glasses".

1989 Digests of Intermag '89–International Magnetic Conference, 28th–31st Mar. 1989, Wash, D.C., p. AP-12, IEEE; A. M. Ghemawat et al.: "New Microcrystalline Hard Magnets in a Co—Zr—B Alloy System".

Patent Abstracts of Japan, vol. 8, No. 277 (E-285) [1714], 18th Dec. 1984; and JP-A-59 147 415 (Hitachi Kinzoku K.K.) 23 Aug. 1984.

*Primary Examiner*—R. Dean
*Assistant Examiner*—Szkyin Ip
*Attorney, Agent, or Firm*—Sughrue, Mion, Zinn, Macpeak & Seas

[57] ABSTRACT

A magnetic alloy with ultrafine crystal grains having a composition represented by the general formula:

$$Co_{100-x-y-z-a-b}Fe_aM_xB_yX_zT_b \text{ (atomic \%)}$$

wherein M represents at least one element selected from Ti, Zr, Hf, V, Nb, Mo, Ta, Cr, W and Mn, X represents at least one element selected from Si, Ge, P, Ga, Al and N, T represents at least one element selected from Cu, Ag, Au, platinum group elements, Ni, Sn, Be, Mg, Ca, Sr and Ba, $0<a\leqq30$, $2\leqq x\leqq15$, $10\leqq y\leqq25$, $0\leqq z\leqq10$, $0<b\leqq10$, and $12<x+y+z+b\leqq35$. Such a magnetic alloy can be produced by producing an amorphous alloy having the above composition, and subjecting the resulting amorphous alloy to a heat treatment to cause crystallization, thereby providing the resulting alloy having a structure, at least 50% of which is occupied by crystal grains having an average grain size of 500 Å or less.

23 Claims, 4 Drawing Sheets

SOFT MAGNETIC ALLOY WITH ULTRAFINE CRYSTAL GRAINS AND METHOD OF PRODUCING SAME

BACKGROUND OF THE INVENTION

The present invention relates to a magnetic alloy with ultrafine crystal grains excellent in magnetic properties and their stability, a major part of the alloy structure being occupied by ultrafine crystal grains, suitable for magnetic cores for transformers, choke coils, etc.

Conventionally used as core materials for magnetic cores such as choke coils are ferrites, silicon steels, amorphous alloys, etc. showing relatively good frequency characteristics with small eddy current losses.

However, ferrites show low saturation magnetic flux densities and their permeabilities are relatively low if the frequency characteristics of their permeabilities are flat up to a high-frequency region. On the other hand, for those showing high permeabilities in a low frequency region, their permeabilities start to decrease at a relatively low frequency. With respect to Fe—Si—B amorphous alloys and silicon steels, they are poor in corrosion resistance and high-frequency magnetic properties.

In the case of Co-base amorphous alloys, their magnetic properties vary widely with time, suffering from low reliability.

In view of these problems, various attempts have been made. For instance, Japanese Patent Laid-Open No. 64-73041 discloses a Co—Fe—B alloy having a high saturation magnetic flux density and a high permeability. However, it has been found that this alloy is poor in heat resistance and stability of magnetic properties with time.

OBJECT AND SUMMARY OF THE INVENTION

Accordingly, an object of the present invention is to provide a magnetic alloy having high permeability and a low core loss required for magnetic parts such as choke coils, the stability of these properties being stable with time, and further showing excellent heat resistance and corrosion resistance.

As a result of intense research in view of the above object, the inventors have found that in the Co—Fe—B crystalline alloys, by increasing the amount of B than that described in Japanese Patent Laid-Open No. 64-73041 and adding a transition metal selected from Nb, Ta, Zr, Hf, etc. to the alloys, the alloys have ultrafine crystal structures, thereby solving the above-mentioned problems. The present invention has been made based upon this finding.

Thus, the magnetic alloy with ultrafine crystal grains according to the present invention has a composition represented by the general formula:

$$Co_{100-x-y}M_xB_y \text{ (atomic \%)}$$

wherein M represents at least one element selected from Ti, Zr, Hf, V, Nb, Mo, Ta, Cr, W and Mn, $2 \leqq x \leqq 15$, $10 < y \leqq 25$, and $12 < x+y \leqq 35$, at least 50% of the alloy structure being occupied by crystal grains having an average grain size of 500 Å or less.

DETAILED DESCRIPTION OF THE INVENTION

Figure 1:
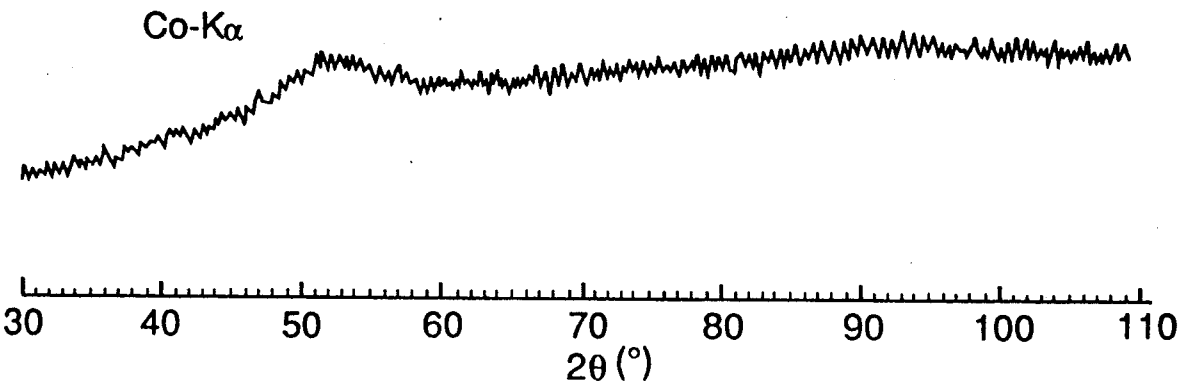
FIG. 1 is a graph showing an X-ray diffraction pattern of the alloy of the present invention before heat treatment.

In the above magnetic alloy of the present invention, B is an indispensable element, effective for making the crystal grains ultrafine and controlling the alloy's magnetostriction and magnetic anisotropy.

M is at least one element selected from Ti, Zr, Hf, V, Nb, Mo, Ta, Cr, W and Mn, which is also an indispensable element.

By the addition of both M and B, the crystal grains can be made ultrafine.

The M content (x), the B content (y) and the total content of M and B (x+y) should meet the following requirements:

$$2 \leqq x \leqq 15.$$

$$10 < y \leqq 25.$$

$$12 < x+y \leqq 35.$$

When x and y are lower than the above lower limits, the alloy has poor soft magnetic properties and heat resistance. On the other hand, when x and y are larger than the above upper limits, the alloy has poor saturation magnetic flux density and soft magnetic properties. Particularly, the preferred ranges of x and y are:

$$5 \leqq x \leqq 15.$$

$$10 < y \leqq 20.$$

$$12 < x+y \leqq 30.$$

With these ranges, the alloys show excellent high-frequency soft magnetic properties and heat resistance.

According to another aspect of the present invention, the above composition may further contain either one or two components selected from Fe, at least one element (X) selected from Si, Ge, P, Ga, Al and N, at least one element (T) selected from Cu, Ag, Au, platinum group elements, Ni, Sn, Be, Mg, Ca, Sr and Ba.

Accordingly, the following alloys are also included in the present application.

$$Co_{100-a-x-y}Fe_aM_xB_y \text{ (atomic \%)} \quad (1)$$

wherein $0 < a \leqq 30$, $2 \leqq x \leqq 15$, $10 < y \leqq 25$, and $12 < x+y \leqq 35$.

$$Co_{100-x-y-x}M_xB_yX_z \text{ (atomic \%)} \quad (2)$$

wherein $2 \leqq x \leqq 15$, $10 < y \leqq 25$, $0 < z \leqq 10$, and $12 < x+y+z \leqq 35$.

$$Co_{100-x-y-b}M_xB_yT_b \text{ (atomic \%)} \quad (3)$$

wherein $2 \leqq x \leqq 15$, $10 < y \leqq 25$, $0 < b \leqq 10$, and $12 < x+y+b \leqq 35$.

$$Co_{100-a-x-y-z}Fe_aM_xB_yX_z \text{ (atomic \%)} \quad (4)$$

wherein $0 < a \leqq 30$, $2 \leqq x \leqq 15$, $10 < y \leqq 25$, $0 < z \leqq 10$, and $12 < x+y+z \leqq 35$ $$Co_{100-x-y-a-b}Fe_aM_xB_yT_b \text{ (atomic \%)} \quad (5)$$

wherein $0 < a \leqq 30$, $2 \leqq x \leqq 15$, $10 < y \leqq 25$, $0 < b \leqq 10$, and $12 < x+y+b \leqq 35$.

$$Co_{100-x-y-z-b}M_xB_yX_zT_b \text{ (atomic \%)} \quad (6)$$

wherein $2 \leqq x \leqq 15$, $10 < y \leqq 25$, $0 < z \leqq 10$, $0 < b \leqq 10$, and $12 < x+y+z+b \leqq 35$.

$$Co_{100-x-y-z-a-b}Fe_aM_xB_yX_zT_b \text{ (atomic \%)} \quad (7)$$

wherein $0 < a \leqq 30$, $2 \leqq x \leqq 15$, $10 < y \leqq 25$, $0 < z \leqq 10$, $0 < b \leqq 10$, and $12 < x+y+z+b \leqq 35$.

With respect to Fe, it may be contained in an amount of 30 atomic % or less, to improve permeability.

With respect to the element X, it is effective to control magnetostriction and magnetic anisotropy, and it may be added in an amount of 10 atomic % or less. When the amount of the element X exceeds 10 atomic %, the deterioration of saturation magnetic flux density, soft magnetic properties and heat resistance takes place.

With respect to the element T, it is effective to improve corrosion resistance and to control magnetic properties. The amount T (b) is preferably 10 atomic % or less. When it exceeds 10 atomic %, extreme decrease in saturation magnetic flux density takes place.

Each of the above-mentioned alloys of the present invention has a structure based on Co crystal grains with B compounds. The crystal grains have an average grain size of 500 Å or less. Particularly when the average grain size is 200 Å or less, excellent soft magnetic properties can be obtained.

The reason why excellent soft magnetic properties can be obtained in the magnetic alloy with ultrafine crystal grains of the present invention are considered as follows: In the present invention, M and B form ultrafine compounds uniformly dispersed in the alloy structure by a heat treatment, suppressing the growth of Co crystal grains. Accordingly, the magnetic anisotropy is apparently offset by this action of making the crystal grains ultrafine, resulting in excellent soft magnetic properties.

In the present invention, ultrafine crystal grains should be at least 50% of the alloy structure, because if otherwise, excellent soft magnetic properties would not be obtained.

According to a further aspect of the present invention, there is provided a method of producing a magnetic alloy with ultrafine crystal grains comprising the steps of producing an amorphous alloy having either one of the above-mentioned compositions, and subjecting the resulting amorphous alloy to a heat treatment to cause crystallization, thereby providing the resulting alloy having a structure, at least 50% of which is occupied by crystal grains having an average grain size of 500 Å or less.

Depending upon the heat treatment conditions, an amorphous phase may remain partially, or the alloy structure may become 100% crystalline. In either case, excellent soft magnetic properties can be obtained.

The amorphous alloy is usually produced by a liquid quenching method such as a single roll method, a double roll method, a rotating liquid spinning method, an atomizing method, etc. The amorphous alloy is subjected to heat treatment in an inert gas atmosphere, in hydrogen or in vacuum to cause crystallization, so that at least 50% of the alloy structure is occupied by crystal grains having an average grain size of 500 Å or less. In the process of crystallization, the B compounds, contributing to the generation of an ultrafine structure. The B compounds formed appear to be compounds of B and M elements (at least one element selected from Ti, Zr, Hf, V, Nb, Mo, Ta, Cr, W and Mn).

The heat treatment according to the present invention is usually conducted at 450° C.–800° C., which means that an extremely high temperature can be employed in this heat treatment. The alloy of the present invention can be subjected to a heat treatment in a magnetic field. When a magnetic field is applied in one direction, magnetic anisotropy in one direction can be generated.

By conducting the heat treatment in a rotating magnetic field, further improvement in soft magnetic properties can be achieved. In addition, the heat treatment for crystallization can be followed by a heat treatment in a magnetic field. Incidentally, by increasing the temperature of a roll, and controlling the cooling conditions, the alloy of the present invention can be produced directly without passing through a state of an amorphous alloy.

The present invention will be explained in further detail by way of the following Examples, without intending to restrict the scope of the present invention.

EXAMPLE 1

An alloy melt having a composition (atomic %) of 7% Nb, 22% B and substantially balance Co was rapidly quenched by a single roll method to produce a thin amorphous alloy ribbon of 5 mm in width and 12 μm in thickness.

The X-ray diffraction pattern of this amorphous alloy before a heat treatment is shown in FIG. 1.

It is clear from FIG. 1 that this pattern is a halo pattern peculiar to an amorphous alloy. This alloy had an crystallization temperature of 480° C. Next, this thin alloy ribbon was formed into a toroidal core of 19 mm in outer diameter and 15 mm in inner diameter, and this core was subjected to a heat treatment at 400° C.–700° C. in an Ar gas atmosphere to cause crystallization.

Figure 2:
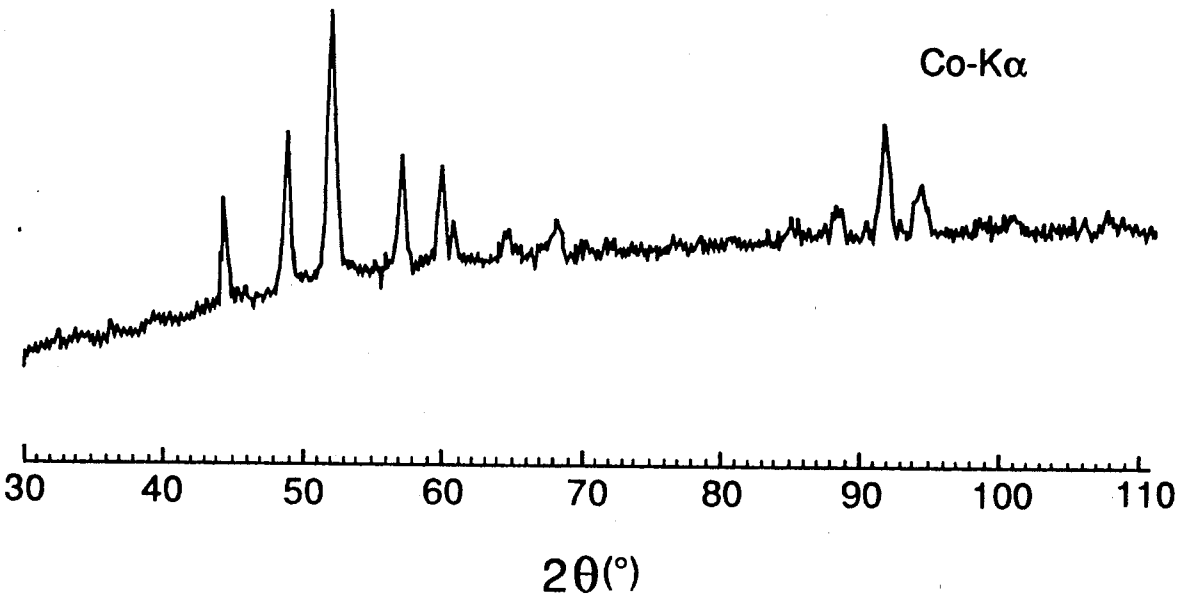
FIG. 2 is a graph showing an X-ray diffraction pattern of the alloy of the present invention heat-treated at 700° C.

The X-ray diffraction pattern of the alloy obtained by the heat treatment at 700° C. is shown in FIG. 2. As a result of X-ray diffraction analysis and transmission electron photomicrography, it was confirmed that the alloy after a 700° C. heat treatment had a structure, almost 95% of which is constituted by ultrafine crystal grains made of Co and B compounds and having an average grain size of 80 Å.

Figure 3:
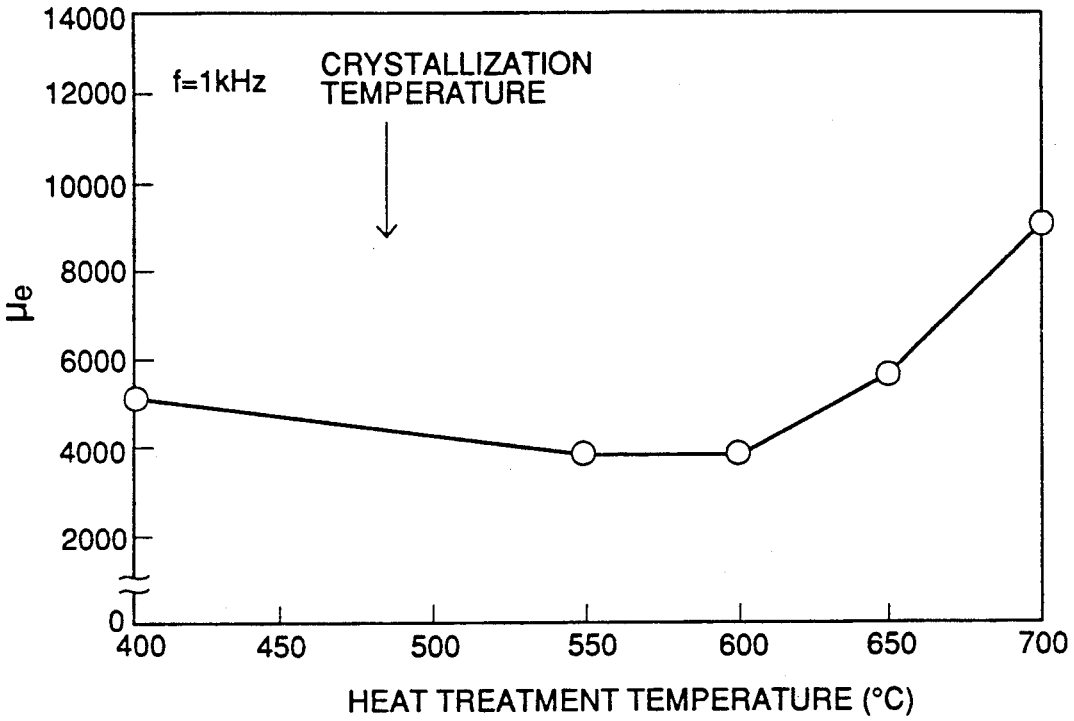
FIG. 3 is a graph showing the relation between effective permeability and heat treatment temperature.
Figure 4:
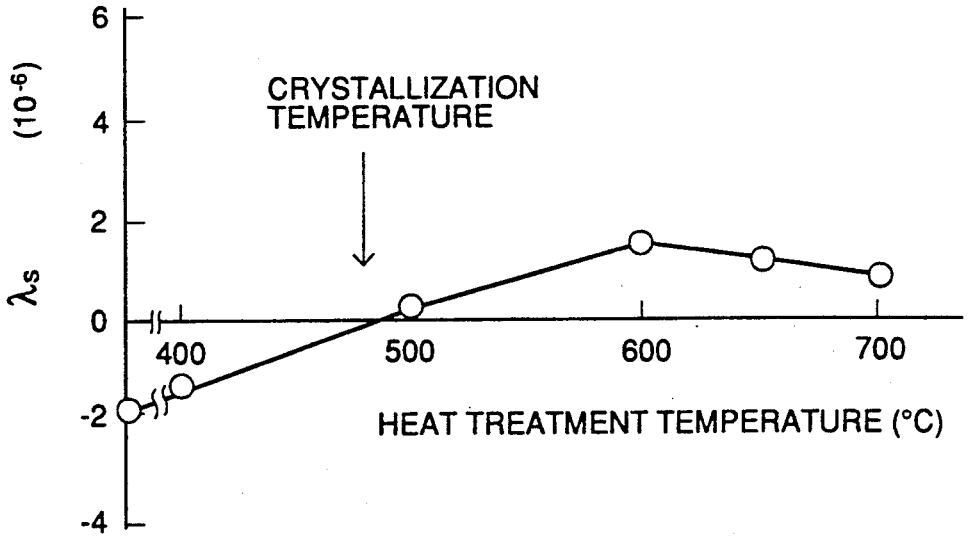
FIG. 4 is a graph showing the relation between a heat treatment temperature and saturation magnetostriction.

FIG. 3 shows the dependency of effective permeability $\mu_e$ at 1 kHz on a heat treatment temperature, and FIG. 4 shows the dependency of saturation magnetostriction $\lambda_s$ on a heat treatment temperature. In either case, the heat treatment was conducted at various temperatures for 1 hour without applying a magnetic field.

It is clear from FIGS. 3 and 4 that even at a high heat treatment temperature exceeding the crystallization temperature, good soft magnetic properties can be obtained, and that their levels are comparable to those of amorphous alloys. With respect to saturation magnetostriction, it increases from a negative value in an amorphous state to larger than 0 when the heat treatment temperature exceeds the crystallization temperature, and becomes a positive value of about $+1\times10^{-8}$ at 700° C. Thus, it is confirmed that the alloy of the present invention shows low magnetostriction.

Next, with respect to a wound core constituted by an amorphous alloy heat-treated at 400° C. and a wound core constituted by a crystalline alloy obtained by a heat treatment at 700° C., they were kept at 120° C. for 1000 hours to measure their effective permeability $\mu_e$ at 1 kHz. As a result, it was observed that the effective permeability $\mu_e$ was reduced to 80% of the initial level in the case of the amorphous alloy, while it was reduced only to 97% of the initial value in the case of the alloy of the present invention. Thus, it was confirmed that the alloy of the present invention suffers from only slight change of effective permeability with time.

EXAMPLE 2

Thin amorphous alloy ribbons of 5 mm in width and 18 μm in thickness having the compositions shown in Table 1 were produced by a single roll method. Next, each of these thin alloy ribbons was formed into a toroidal core of 19 mm in outer diameter and 15 mm in inner diameter, and subjected to a heat treatment at 550° C.-800° C. in an Ar gas atmosphere to cause crystallization.

As a result of X-ray diffraction analysis and transmission electron photomicrography, it was confirmed that the alloys after the heat treatment had structures mostly constituted by ultrafine crystal grains made of Co and B compounds and having an average grain size of 500 Å or less. The details are shown in Table 1.

With respect to the magnetic cores after the heat treatment, core loss Pc at f=100 kHz and Bm=2 kG, and an effective permeability ($\mu_{elk}$) at 1 kHz were measured. The results are shown in Table 1. The magnetic cores were also kept in a furnace at 600° C. for 30 minutes, and then cooled to room temperature to measure core loss Pc'. The ratios of Pc'/Pc are also shown in Table 1.

Further, thin alloy ribbons subjected to heat treatment were immersed in tap water for 1 week to evaluate corrosion resistance. Results are shown in Table 1, in which represents alloys having substantially no rust, Δ represents those having slight rust, and x represents those having large rusts. Effective permeability $\mu_{elk}$(24) at 1 kHz after keeping at 120° C. for 24 hours was measured. The values of $\mu_{elk}(24)/\mu_{elk}$ are shown in Table 1.

It is clear from Table 1 that the alloys of the present invention show extremely high permeability, low core loss and excellent corrosion resistance. Accordingly, they are suitable as magnetic core materials for transformers, chokes, etc. Further, since their Pc'/Pc is nearly 1, their excellent heat resistance is confirmed, and since their $\mu_{elk}(24)/\mu_{elk}$ is near 1, it is confirmed that the change of magnetic properties with time is small. Thus, the alloys of the present invention are suitable for practical applications.

TABLE 1

| Sample No.* | Composition (atomic %) | Average Grain Size (Å) | Crystal Grain Content (%) | Pc (mW/cc) | $\mu_{elk}$ | Corrosion Resistance** | Pc'/Pc | $\mu_{elk}(24)/\mu_{elk}$ |
|---|---|---|---|---|---|---|---|---|
| 1 | $Co_{bal}Zr_7B_{22}$ | 50 | 80 | 520 | 9100 | ○ | 1.02 | 0.99 |
| 2 | $Co_{bal}Hf_7B_{22}$ | 60 | 90 | 530 | 8800 | ○ | 1.03 | 0.98 |
| 3 | $Co_{bal}Ta_8B_{19}$ | 50 | almost 100 | 460 | 9600 | ○ | 1.02 | 1.00 |
| 4 | $Co_{bal}Nb_8B_{23}$ | 40 | 90 | 440 | 7200 | ○ | 1.01 | 1.01 |
| 5 | $Co_{bal}Fe_5Hf_8Mn_{0.8}B_{19}Ga_{0.5}$ | 55 | 79 | 470 | 7900 | ○ | 0.99 | 0.97 |
| 6 | $Co_{bal}Fe_6Ni_2Zr_9B_{20}Al_1$ | 56 | 90 | 480 | 7700 | ○ | 1.01 | 0.98 |
| 7 | $Co_{bal}Ti_{10}B_{22}Ga_{0.8}$ | 75 | 95 | 510 | 8200 | ○ | 1.04 | 1.00 |
| 8 | $Co_{bal}Zr_{13}B_{20}P_{0.7}Cu_1$ | 40 | 80 | 520 | 8500 | ○ | 1.02 | 0.99 |
| 9 | $Co_{bal}Hf_{10}B_{22}Si_1Ru_2$ | 55 | 90 | 440 | 8200 | ○ | 1.03 | 0.98 |
| 10 | $Co_{bal}Fe_8Nb_8B_{19}Ge_1Ni_1$ | 80 | 75 | 480 | 7200 | ○ | 0.99 | 0.99 |
| 11 | $Co_{bal}Zr_8B_{24}Be_{0.5}Rh_2$ | 70 | 90 | 460 | 6800 | ○ | 1.01 | 0.97 |
| 12 | $Co_{bal}Fe_{4.7}Si_{15}B_{10}$ Amorphous | — | — | — | 8500 | ○ | 36.8 | 0.62 |
| 13 | $Fe_{bal}Al_{7.6}Si_{17.9}$ | — | — | — | 10000 | Δ | 1.11 | 1.00 |
| 14 | $Fe_{bal}Si_{12.5}$ | — | — | — | 2800 | x | 1.21 | 0.99 |

Note
*: Sample Nos. 1-11: Present invention.
Sample Nos. 12-14: Conventional alloy.
**: Corrosion resistance
○: Good.
Δ: Fair.
x: Poor.

EXAMPLE 3

An alloy melt having a composition (atomic %) of 7% Nb, 2% Ta. 5% Fe, 23% B and balance substantially Co was rapidly quenched by a single roll method in a helium gas atmosphere at a reduced pressure to produce a thin amorphous alloy ribbon of 6 μm in thickness. Next, this thin amorphous alloy ribbon was coated with MgO powder in a thickness of 0.5 μm by an electrophoresis method and then wound to a toroidal core of 15 mm in outer diameter and 13 mm in inner diameter. This core was subjected to a heat treatment in an argon gas atmosphere while applying a magnetic field in a direction parallel to the width of the thin ribbon. It was kept at 700° C. in a magnetic field of 4000 Oe, and then cooled at about 5° C./min. The heat-treated alloy was crystalline, having a crystalline structure substantially 100% composed of ultrafine crystal grains having an average grain size of 90 Å.

Figure 5:
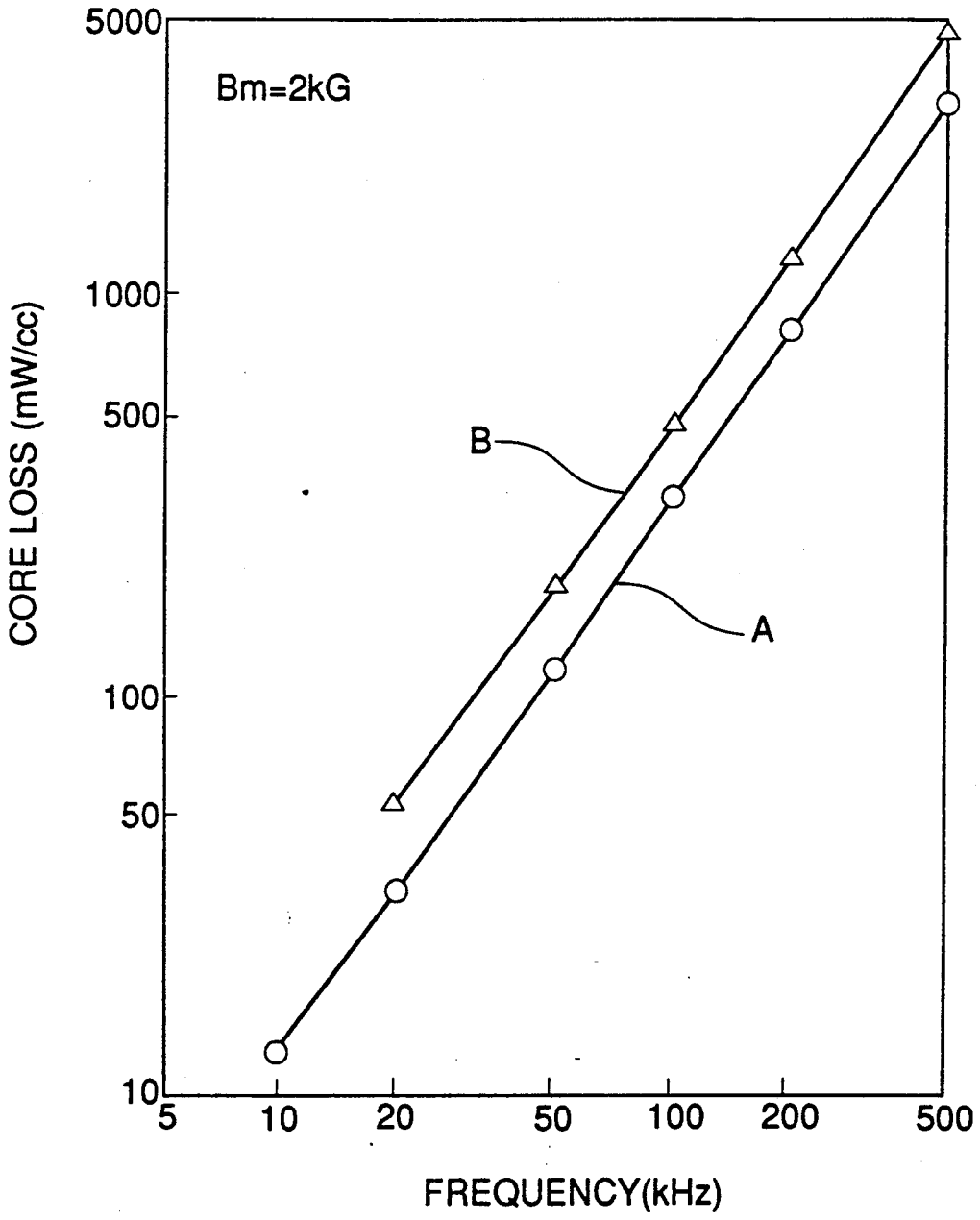
FIG. 5 is a graph showing the relation between a core loss and frequency with respect to the alloy of the present invention.

FIG. 5 shows the frequency characteristics of core loss at $B_m=2$ kG with respect to the heat-treated magnetic core (A) of the present invention. For comparison, a magnetic core (B) made of Mn-Zn ferrite is also shown.

It is clear from FIG. 5 that the alloy of the present invention shows low core loss, meaning that it is promising for high-frequency transformers, etc.

EXAMPLE 4

An amorphous alloy layer of 3 μm in thickness having a composition (atomic %) of 7.2% Nb, 18.8% B and balance substantially Co was formed on a fotoceram substrate by an RF sputtering apparatus. In an X-ray diffraction analysis, the layer showed a halo pattern peculiar to an amorphous alloy. This amorphous alloy layer was heated at 650° C. for 1 hour in a nitrogen gas atmosphere and then cooled to room temperature to measure X-ray diffraction. As a result, Co crystal peaks and slight NbB compound phase peaks were observed. As a result of transmission electron photomicrography, it was confirmed that substantially 100% of the alloy structure was occupied by ultrafine crystal grains having an average grain size of 90 Å.

Next, this layer was measured with respect to effective permeability $\mu_{elM}$ at 1 MHz by an LCR meter. Thus, it was found that $\mu_{elM}$ was 2200. The details are shown in Table 2.

EXAMPLE 5

Alloy layers having compositions shown in Table 2 were produced on fotoceram substrates in the same manner as in Example 4. Their saturation magnetic flux densities $B_{10}$ were measured by a vibration-type magnetometer, and their effective permeabilities $\mu_{elM}$ at 1 MHz were measured by an LCR meter. The results are shown in Table 2. Incidentally, any heat-treated alloy had an ultrafine crystalline structure having an average grain size of 500 Å or less. The details are shown in Table 2.

Since the alloys of the present invention showed as high saturation magnetic flux densities and $\mu_{elM}$ as those of Fe—Si—Al alloys, the alloys of the present invention are suitable for magnetic heads.

TABLE 2

| Sample No.* | Composition (atomic %) | Average Grain Size (Å) | Crystal Grain Content (%) | $\mu_{elM}$ | Phase Structure |
|---|---|---|---|---|---|
| 15 | $Co_{bal}Zr_{8.2}B_{11.5}$ | 140 | 90 | 2900 | Co + Zr − B Compound |
| 16 | $Co_{bal}Hf_{7.5}B_{12.4}$ | 90 | 80 | 2700 | Co + Hf − B Compound |
| 17 | $Co_{bal}Ta_{7.8}B_{15.1}$ | 70 | 70 | 2500 | Co + Ta − B Compound |
| 18 | $Co_{bal}Nb_{8.2}B_{13.2}$ | 80 | 90 | 1800 | Co + Nb − B Compound |
| 19 | $Co_{bal}Cr_{12.1}B_{13.2}Si_{0.9}$ | 200 | 90 | 1100 | Co + Cr − B Compound |
| 20 | $Co_{bal}W_{8.5}B_{14.3}Ge_{1.2}$ | 60 | 90 | 1300 | Co + W − B Compound |
| 21 | $Co_{bal}Hf_{8.3}B_{12.9}Ga_{1.1}$ | 90 | 80 | 1700 | Co + Hf − B Compound |
| 22 | $Co_{bal}Zr_{8.5}B_{15.9}Al_{1.2}$ | 65 | almost 100 | 1800 | Co + Zr − B Compound |
| 23 | $Co_{bal}Nb_{8.7}B_{14.8}N_{0.3}$ | 50 | 85 | 1100 | Co + Nb − B Compound |
| 24 | $Co_{bal}Mo_{12.0}B_{16.8}Al_{1.4}$ | 130 | 80 | 1200 | Co + Mo − B Compound |
| 25 | $Co_{bal}Ti_{10.5}B_{18.1}Ga_{1.3}$ | 120 | 90 | 1100 | Co + Ti − B Compound |
| 26 | $Co_{bal}Zr_{12.7}B_{17.3}P_{1.2}$ | 40 | 90 | 1000 | Co + Zr − B Compound |
| 27 | $Co_{bal}Hf_{9.7}B_{14.3}Si_{1.1}$ | 80 | 75 | 1800 | Co + Hf − B Compound |
| 28 | $Co_{bal}Nb_{7.7}B_{11.8}Ge_{1.1}$ | 60 | 95 | 1000 | Co + Nb − B Compound |
| 29 | $Co_{bal}Ti_{13.8}B_{12.2}Sn_{1.8}$ | 70 | almost 100 | 1100 | Co + Ti − B Compound |
| 30 | $Co_{bal}Zr_{10.1}B_{12.6}Be_{1.3}$ | 65 | 95 | 1800 | Co + Zr − B Compound |
| 31 | $Fe_{bal}Al_{7.6}Si_{17.9}$ | 1000 | 100 | 1500 | bcc Fe |
| 32 | $Fe_{bal}Si_{12.5}$ | 1500 | 100 | 400 | bcc Fe |
| 33 | $Co_{bal}Nb_{13.0}Zr_{3.0}$ Amorphous | — | — | 3500 | Amorphous |

Note
*: Sample Nos. 15-30: Present invention.
Sample Nos. 31-33: Conventional alloy.

EXAMPLE 6

Thin amorphous alloy ribbons of 5 mm in width and 15 μm in thickness having compositions shown in Table 3 were produced by a single roll method. Next, each of these thin alloy ribbons was formed into a toroidal core of 19 mm in outer diameter and 15 mm in inner diameter, and subjected to a heat treatment at 550° C.-700° C. in an Ar gas atmosphere to cause crystallization.

As a result of X-ray diffraction analysis and transmission electron photomicrography, it was confirmed that the alloys after the heat treatment had structures mostly constituted by ultrafine crystal grains made of Co and B compounds and having an average grain size of 500 Å or less. The details are shown in Table 3.

TABLE 3

| Sample No.* | Composition (atomic %) | Average Grain Size (Å) | Crystal Grain Content (%) | $\mu_{elM}$ | Phase Structure |
|---|---|---|---|---|---|
| 34 | $Co_{bal}Zr_8B_{12}$ | 80 | almost 100 | 3300 | Co + Zr − B Compound |
| 35 | $Co_{bal}Hf_7B_{12}$ | 90 | almost 100 | 3600 | Co + Hf − B Compound |
| 36 | $Co_{bal}Ta_8B_{15}$ | 60 | 90 | 3200 | Co + Ta − B Compound |
| 37 | $Co_{bal}Nb_8B_{13}$ | 50 | almost 100 | 2600 | Co + Nb − B Compound |
| 38 | $Co_{bal}Hf_8Mn_{0.6}B_{13}Ga_1$ | 80 | 95 | 2800 | Co + Hf − B Compound |
| 39 | $Co_{bal}Zr_9B_{16}Al_1$ | 60 | 85 | 2200 | Co + Zr − B Compound |
| 40 | $Co_{bal}Ti_{11}B_{18}Ga_{0.5}$ | 70 | 90 | 2300 | Co + Ti − B Compound |
| 41 | $Co_{bal}Zr_{13}B_{17}P_{0.5}Cu_1$ | 50 | almost 100 | 2400 | Co + Zr − B Compound |
| 42 | $Co_{bal}Hf_{10}B_{14}Si_1Ru_1Cu_5$ | 60 | almost 100 | 2500 | Co + Hf − B Compound |
| 43 | $Co_{bal}Nb_8B_{11}Ge_1Ni_1$ | 80 | almost 100 | 2800 | Co + Nb − B Compound |
| 44 | $Co_{bal}Zr_{10}B_{13}Be_{0.5}Rh_1$ | 70 | almost 100 | 2300 | Co + Zr − B Compound |
| 45 | $Co_{bal}Nb_{13}Zr_3$ Amorphous | — | — | 2300 | Amorphous |
| 46 | $Fe_{bal}Al_{7.6}Si_{17.9}$ | — | — | 1500 | bcc Fe |
| 47 | $Fe_{bal}Si_{12.5}$ | — | — | 400 | bcc Fe |

Note
*: Sample Nos. 34–44: Present invention.
Sample Nos. 45–47: Conventional alloy.

EXAMPLE 7

Alloy layers having compositions shown in Table 4 were produced on fotoceram substrates in the same manner as in Example 4, and subjected to a heat treatment at 650° C. for 1 hour to cause crystallization. The average grain size and the percentage of crystal grains of each heat-treated alloy are shown in Table 4. At this stage, their $\mu_{elMO}$ was measured. Next, these alloys were introduced into an oven at 600° C., and kept for 30 minutes and cooled to room temperature to measure their $\mu_{elM'}$. Their $\mu_{elM'}/\mu_{elMO}$ ratios are shown in Table 4.

The alloy layers of the present invention show $\mu_{elM'}/\mu_{elMO}$ close to 1, and suffer from little deterioration of magnetic properties even at a high temperature, showing good heat resistance. On the other hand, the conventional Co—Fe—B alloy and the amorphous alloy show $\mu_{elM'}/\mu_{elMO}$ much smaller than 1, meaning that their magnetic properties are deteriorated. Thus, the alloys of the present invention are suitable for producing high-reliability magnetic heads.

TABLE 4

| Sample No.* | Composition (atomic %) | Average Grain Size (Å) | Crystal Grain Content (%) | $\mu_{elM'}/\mu_{elM0}$ | Phase Structure |
|---|---|---|---|---|---|
| 48 | $Co_{bal}Fe_{15.1}Zr_{8.6}B_{17.2}$ | 130 | almost 100 | 0.96 | Co + Zr − B Compound |
| 49 | $Co_{bal}Hf_{8.7}B_{10.5}$ | 120 | almost 100 | 0.95 | Co + Hf − B Compound |
| 50 | $Co_{bal}Fe_{0.2}Ta_{7.7}B_{11.2}$ | 110 | 95 | 0.94 | Co + Ta − B Compound |
| 51 | $Co_{bal}Nb_{8.3}B_{22.5}$ | 90 | almost 100 | 0.92 | Co + Nb − B Compound |
| 52 | $Co_{bal}Cr_{12.2}B_{25.1}Si_{0.6}$ | 460 | almost 100 | 0.90 | Co + Cr − B Compound |
| 53 | $Co_{bal}W_{8.9}B_{14.4}Ge_{1.4}$ | 130 | 90 | 0.91 | Co + W − B Compound |
| 54 | $Co_{bal}Mn_{12.4}B_{12.2}Ga_{1.1}$ | 440 | almost 100 | 0.92 | Co + Mn − B Compound |
| 55 | $Co_{bal}Hf_{8.3}B_{12.2}Ga_{1.1}$ | 70 | 95 | 0.91 | Co + Hf − B Compound |
| 56 | $Co_{bal}Zr_{8.6}B_{16.9}Al_{1.5}$ | 90 | 90 | 0.87 | Co + Zr − B Compound |
| 57 | $Co_{bal}Nb_{8.9}B_{15.9}N_{0.8}$ | 80 | almost 100 | 0.88 | Co + Nb − B Compound |
| 58 | $Co_{bal}Mo_{12.1}B_{16.9}Al_{1.2}$ | 230 | almost 100 | 0.98 | Co + Mo − B Compound |

TABLE 4-continued

| Sample No.* | Composition (atomic %) | Average Grain Size (Å) | Crystal Grain Content (%) | $\mu_{e1M}/\mu_{e1M0}$ | Phase Structure |
|---|---|---|---|---|---|
| 59 | $Co_{bal}Fe_{12.2}Ti_{10.5}B_{18.1}$ | 140 | 95 | 0.91 | Co + Ti − B Compound |
| 60 | $Co_{bal}Zr_{13.7}B_{17.4}P_{2.2}$ | 80 | 90 | 0.90 | Co + Zr − B Compound |
| 61 | $Co_{bal}Hf_{9.6}B_{14.2}Si_{1.2}$ | 160 | 85 | 0.88 | Co + Hf − B Compound |
| 62 | $Co_{bal}Fe_{8.8}Ta_{8.2}B_{12.2}$ | 70 | 95 | 0.90 | Co + Ta − B Compound |
| 63 | $Co_{bal}Fe_{12}Ti_{13.8}B_{11.6}$ | 120 | 95 | 0.87 | Co + Ti − B Compound |
| 64 | $Co_{bal}Fe_{12}Ti_{13.8}B_{12.2}$ | 90 | almost 100 | 0.89 | Co + Ti − B Compound |
| 65 | $Co_{bal}Zr_{10.3}B_{12.8}Be_{0.4}$ | 80 | almost 100 | 0.90 | Co + Zr − B Compound |
| 66 | $Co_{bal}Fe_6B_6Si_2$ | — | — | 0.12 | fcc Fe |
| 67 | $Co_{bal}Nb_{13.0}Zr_4$ | — | — | 0.12 | Amorphous |

According to the present invention, magnetic alloys with ultrafine crystal grains having excellent permeability, corrosion resistance, heat resistance and stability of magnetic properties with time and low core loss can be produced.

What is claimed is:

1. A magnetic alloy with ultrafine crystal grains having a composition represented by the general formula:

$$Co_{100-x-y}M_xB_y \text{ (atomic \%)}$$

wherein M represents at least one element selected from Ti, Zr, Hf, V, Nb, Mo, Ta, Cr, W and Mn, $2 \leqq x \leqq 15$, $10 < y \leqq 25$, and $12 < x+y \leqq 35$, at least 50% of the alloy structure being occupied by crystal grains having an average grain size of 200 Å or less.

2. A magnetic alloy with ultrafine crystal grains having a composition represented by the general formula:

$$Co_{100-a-x-y}Fe_aM_xB_y \text{ (atomic \%)}$$

wherein M represents at least one element selected from Ti, Zr, Hf, V, Nb, Mo, Ta, Cr, W and Mn, $0 < a \leqq 30$, $2 \leqq x \leqq 15$, $10 < y \leqq 25$, and $12 < x+y \leqq 35$, at least 50% of the alloy structure being occupied by crystal grains having an average grain size of 200 Å or less.

3. A magnetic alloy with ultrafine crystal grains having a composition represented by the general formula:

$$Co_{100-x-y-z}M_xB_yX_z \text{ (atomic \%)}$$

wherein M represents at least one element selected from Ti, Zr, Hf, V, Nb, Mo, Ta, Cr, W and Mn, X represents at least one element selected from Si, Ge, P, Ga, Al and N, $2 \leqq x \leqq 15$, $10 < y \leqq 25$, $0 < z \leqq 10$, and $12 < x+y+z \leqq 35$, at least 50% of the alloy structure being occupied by crystal grains having an average grain size of 200 Å or less.

4. A magnetic alloy with ultrafine crystal grains having a composition represented by the general formula:

$$Co_{100-x-y-b}M_xB_yT_b \text{ (atomic \%)}$$

wherein M represents at least one element selected from Ti, Zr, Hf, V, Nb, Mo, Ta, Cr, W and Mn, T represents at least one element selected from Cu, Ag, Au, platinum group elements, Ni, Sn, Be, Mg, Ca, Sr and Ba, $2 \leqq x \leqq 15$, $10 < y \leqq 25$, $0 < b \leqq 10$, and $12 < x+y+b \leqq 35$, at least 50% of the alloy structure being occupied by crystal grains having an average grain size of 200 Å or less.

5. A magnetic alloy with ultrafine crystal grains having a composition represented by the general formula:

$$Co_{100-a-x-y-z}Fe_aM_xB_yX_z \text{ (atomic \%)}$$

wherein M represents at least one element selected from Ti, Zr, Hf, V, Nb, Mo, Ta, Cr, W and Mn, X represents at least one element selected from Si, Ge, P, Ga, Al and N, $0 < a \leqq 30$, $2 \leqq x \leqq 15$, $10 < y \leqq 25$, $0 < z \leqq 10$, and $12 < x+y+z \leqq 35$, at least 50% of the alloy structure being occupied by crystal grains having an average grain size of 200 Å or less.

6. A magnetic alloy with ultrafine crystal grains having a composition represented by the general formula:

$$Co_{100-x-y-a-b}Fe_aM_xB_yT_b \text{ (atomic \%)}$$

wherein M represents at least one element selected from Ti, Zr, Hf, V, Nb, Mo, Ta, Cr, W and Mn, T represents at least one element selected from Cu, Ag, Au, platinum group elements, Ni, Sn, Be, Mg, Ca, Sr and Ba, $0 < a \leqq 30$, $2 \leqq x \leqq 15$, $10 < y \leqq 25$, $0 < b \leqq 10$, and $12 < x+y+b \leqq 35$, at least 50% of the alloy structure being occupied by crystal grains having an average grain size of 200 Å or less.

7. A magnetic alloy with ultrafine crystal grains having a composition represented by the general formula:

$$Co_{100-x-y-z-b}M_xB_yX_zT_b \text{ (atomic \%)}$$

wherein M represents at least one element selected from Ti, Zr, Hf, V, Nb, Mo, Ta, Cr, W and Mn, X represents at least one element selected from Si, Ge, P, Ga, Al and N, T represents at least one element selected from Cu, Ag, Au, platinum group elements, Ni, Sn, Be, Mg, Ca, Sr and Ba, $2 \leqq x \leqq 15$, $10 < y \leqq 25$, $0 < z \leqq 10$, $0 < b \leqq 10$, and $12 < x+y+z+b \leqq 35$, at least 50% of the alloy structure being occupied by crystal grains having an average grain size of 200 Å or less.

8. A magnetic alloy with ultrafine crystal grains having a composition represented by the general formula:

$$Co_{100-x-y-z-a-b}Fe_aM_xB_yX_zT_b \text{ (atomic \%)}$$

wherein M represents at least one element selected from Ti, Zr, Hf, V, Nb, Mo, Ta, Cr, W and Mn, X represents at least one element selected from Si, Ge, P, Ga, Al and N, T represents at least one element selected from Cu, Ag, Au, platinum group elements, Ni, Sn, Be, Mg, Ca, Sr and Ba, $0<a\leqq 30$, $2\leqq x\leqq 15$, $10<y\leqq 25$, $0<z\leqq 10$, $0<b\leqq 10$, and $12<x+y+z+b\leqq 35$, at least 50% of the alloy structure being occupied by crystal grains having an average grain size of 200 Å or less.

9. The magnetic alloy with ultrafine crystal grains according to claim 1, wherein the balance of said alloy structure is composed of an amorphous phase.

10. The magnetic alloy with ultrafine crystal grains according to claim 2, wherein the balance of said alloy structure is composed of an amorphous phase.

11. The magnetic alloy with ultrafine crystal grains according to claim 3, wherein the balance of said alloy structure is composed of an amorphous phase.

12. The magnetic alloy with ultrafine crystal grains according to claim 1, wherein said alloy is substantially composed of a crystalline phase.

13. The magnetic alloy with ultrafine crystal grains according to claim 2, wherein said alloy is substantially composed of a crystalline phase.

14. The magnetic alloy with ultrafine crystal grains according to claim 3, wherein said alloy is substantially composed of a crystalline phase.

15. The magnetic alloy according to claim 1, prepared by:

(a) forming an alloy melt of the elements constituting the magnetic alloy;

(b) liquid quenching the alloy melt to form an amorphous alloy; and (c) heat-treating the amorphous alloy at a temperature of from 450°–650° C. to cause crystallization.

16. The magnetic alloy according to claim 2, prepared by:

(a) forming an alloy melt of the elements constituting the magnetic alloy;

(b) liquid quenching the alloy melt to form an amorphous alloy; and (c) heat-treating the amorphous alloy at a temperature of from 450°–650° C. to cause crystallization.

17. The magnetic alloy according to claim 3, prepared by:

(a) forming an alloy melt of the elements constituting the magnetic alloy;

(b) liquid quenching the alloy melt to form an amorphous alloy; and (c) heat-treating the amorphous alloy at a temperature of from 450°–650° C. to cause crystallization.

18. The magnetic alloy according to claim 4, prepared by:

(a) forming an alloy melt of the elements constituting the magnetic alloy;

(b) liquid quenching the alloy melt to form an amorphous alloy; and (c) heat-treating the amorphous alloy at a temperature of from 450°–650° C. to cause crystallization.

19. The magnetic alloy according to claim 5, prepared by:

(a) forming an alloy melt of the elements constituting the magnetic alloy;

(b) liquid quenching the alloy melt to form an amorphous alloy; and (c) heat-treating the amorphous alloy at a temperature of from 450°–650° C. to cause crystallization.

20. The magnetic alloy according to claim 6, prepared by:

(a) forming an alloy melt of the elements constituting the magnetic alloy;

(b) liquid quenching the alloy melt to form an amorphous alloy; and (c) heat-treating the amorphous alloy at a temperature of from 450°–650° C. to cause crystallization.

21. The magnetic alloy according to claim 7, prepared by:

(a) forming an alloy melt of the elements constituting the magnetic alloy;

(b) liquid quenching the alloy melt to form an amorphous alloy; and (c) heat-treating the amorphous alloy at a temperature of from 450°–650° C. to cause crystallization.

22. The magnetic alloy according to claim 8, prepared by:

(a) forming an alloy melt of the elements constituting the magnetic alloy;

(b) liquid quenching the alloy melt to form an amorphous alloy; and (c) heat-treating the amorphous alloy at a temperature of from 450°–650° C. to cause crystallization.

23. The magnetic alloy according to claim 15, wherein said heat-treating is conducted in a magnetic field.

* * * * *